United States Patent [19]

Meadows

[11] Patent Number: 4,932,134

[45] Date of Patent: Jun. 12, 1990

[54] ADJUSTABLE FOUNDATION LOCATING DEVICE

[76] Inventor: Dexter L. Meadows, P.O. Box 9836, Bakersfield, Calif. 93389

[21] Appl. No.: 260,858

[22] Filed: Oct. 21, 1988

[51] Int. Cl.[5] ..... E04G 21/18

[52] U.S. Cl. ..... 33/405; 33/406; 33/413; 33/1 LE; 33/1 H

[58] Field of Search ..... 33/404, 405, 406, 413, 33/1 H, 1 LE

[56] References Cited

U.S. PATENT DOCUMENTS

| | | | |
|---|---|---|---|
| Re. 24,044 | 7/1955 | Breuninger | 33/405 |
| 1,130,926 | 3/1915 | Peck | 33/1 H |
| 1,320,352 | 8/1919 | Werner | 33/1 H |
| 1,336,004 | 4/1920 | Victoria | 33/404 |
| 1,609,912 | 12/1926 | Mazeau | 33/1 H |
| 2,758,379 | 8/1956 | Senk | 33/405 |
| 2,934,826 | 5/1960 | Klaum | 33/405 |
| 3,279,070 | 9/1964 | Blount et al. | 33/1 H |
| 3,425,127 | 2/1969 | Long et al. | 33/406 |
| 3,451,136 | 6/1969 | Shuttle, Jr. | 33/339 |
| 3,861,046 | 1/1975 | Arn | 33/405 |
| 3,890,717 | 6/1975 | Haun | 33/1 LE |
| 4,080,739 | 3/1978 | Ruhaak | 33/1 LE |
| 4,095,343 | 6/1978 | McPhail | 33/1 LE |
| 4,141,146 | 2/1979 | Broom | 33/413 |

FOREIGN PATENT DOCUMENTS

| | | | |
|---|---|---|---|
| 700207 | 11/1953 | United Kingdom | 33/404 |

*Primary Examiner*—Allan N. Shoap

*Assistant Examiner*—Diego F. F. Gutierrez

*Attorney, Agent, or Firm*—Poms, Smith, Lande & Rose

[57] ABSTRACT

An adjustable foundation locating device used to position or locate forms and trenches needed for pouring concrete foundations. The device uses a horizontal member which is supported by a stake driven into the ground. The horizontal member may be moved up or down the stake until it is located at a desirable height and then secured in place by tightening a bolt threaded into a bracket attached to the horizontal member. Sleeve members may be slid back and forth along the longitudinal length of the horizontal member until they are properly located and then secured in place by tightening bolts threaded into the sleeve members. Strings may then be tied to the sleeve members and pulled taut between two devices located at opposite ends of a trench needed for a concrete foundation. The strings may then be used as guides to position or locate the trench or a concrete form needed for pouring the concrete foundation. A stabilizing member may be used to help secure the horizontal member to the stake. The device may be secured across the top of two concrete forms by using the bracket on the device to clamp it to a flange at the top of one of the forms. Adjustable support members may be used with stakes to position one of the horizontal members which slidably engages the suport members. The horizontal member may be secured to the support members by bolts which are threaded into sleeve members of the support members.

20 Claims, 1 Drawing Sheet

ADJUSTABLE FOUNDATION LOCATING DEVICE

BACKGROUND OF THE INVENTION

The present invention relates generally to devices used for locating forms and trenches and, more particularly, to an adjustable foundation locating device using slidable sleeve members on a horizontal member supported by a stake to locate strings horizontally and at proper heights and positions for the purpose of locating concrete forms and trenches used for pouring concrete foundations.

In the past, trenches and concrete forms have been difficult to position or locate for the purpose of pouring concrete footings, foundations, or other concrete structures because of the number of stakes which have to be accurately located in order to support strings used to locate the forms and trenches. Batter boards have been used to determine desired levels for construction purposes and for anchoring strings in order to mark outlines and position forms for different construction projects. However, such boards are difficult to use because they are nailed to stakes and difficult to adjust in order to accurately position forms or locate trenches. Also, since the batter boards are nailed to stakes, they tend to crack and break and often cannot be reused. In addition, rocks and other objects in the ground sometimes make it difficult to drive the stakes into the ground or to accurately locate the stakes. As a result, strings attached to stakes or batter boards are difficult to align for the purpose of locating concrete forms or trenches.

Accordingly, there is a need for an adjustable device that uses a stake which may be used to locate strings horizontally and at proper heights and positions for the purpose of locating forms and trenches needed for pouring concrete foundations. If the device uses a stake which supports a horizontal member having slidable sleeve members, it may be conveniently moved to a location where the stake may be easily driven into the ground and the sleeve members may then be slid along the horizontal member so that the strings may be properly located in order to position the trenches or concrete forms. Also, such a device would be reusable if made out of a durable material such as metal.

SUMMARY OF THE INVENTION

It is an object of this invention to provide an adjustable foundation locating device used to position or locate forms and trenches needed for pouring concrete foundations.

It is another object of this invention to provide an adjustable foundation locating device which uses slidable sleeve members on a horizontal member supported by a stake to locate strings horizontally and at proper heights and positions in order to position or locate forms and trenches needed for pouring concrete foundations.

It is still another object of this invention to provide an adjustable foundation locating device having a horizontal member which may be moved up or down a supporting stake to a desirable height so that it may be used to position or locate various concrete forms of different heights.

It is still another object of this invention to provide an adjustable foundation locating device that has a horizontal member supported by a stake that may be moved horizontally to different positions so that it may be used to position or locate forms and trenches needed for pouring concrete foundations.

It is still another object of this invention to provide an adjustable foundation locating device that uses a stabilizing member to help secure or hold a horizontal member to a stake supporting the horizontal member in order to stabilize the member or to prevent it from coming loose from the stake.

These and other objects and advantages are attained by an adjustable foundation locating device used to position or locate forms and trenches needed for pouring concrete foundations. The device uses a horizontal member which is supported by a stake driven into the ground. The horizontal member may be moved up or down the stake until it is located at a desirable height and then secured in place by tightening a bolt threaded into a bracket attached to the horizontal member. Sleeve members may be slid back and forth along the longitudinal length of the horizontal member until they are properly located and then secured in place by tightening bolts threaded into the sleeve members. Strings may then be tied to the sleeve members and pulled taut between two devices located at opposite ends of a trench needed for a concrete foundation. The strings may then be used as guides to position or locate the trench or a concrete form needed for pouring the concrete foundation.

A stabilizing member may be used to help secure the horizontal member to the stake. The stabilizing member slides along the horizontal member like the sleeve members and has a block member which may be securely positioned next to the stake in order to help hold the horizontal member to the stake, or to keep it from coming loose from the stake.

The device may be secured across the top of two concrete forms by using the bracket on the device to clamp the device to a flange at the top of one of the forms. The stabilizing member or a sleeve member may be used in conjunction with the bracket to help secure the device to the top of the forms.

Adjustable support members may be used with stakes to position one of the horizontal members which slidably engages hollow sleeve members of the adjustable support members. The support members may be positioned up or down the stakes by bolts threaded into U-shaped brackets attached to the support members. The horizontal member may be secured to the support members by bolts threaded into the sleeve members.

The various features of the present invention will be best understood together with further objects and advantages by reference to the following description of the preferred embodiment taken in conjunction with the accompanying drawings.

BRIEF DESCRIPTION OF THE DRAWINGS

FIG. 8 is a perspective view of the device of FIG. 1 showing a stabilizing member mounted on the horizontal member;

FIG. 9 is a top plan view of the device of FIG. 1 illustrating how the stabilizing member may be used to help secure the horizontal member to the stake;

FIG. 10 is a view taken similar to FIG. 9 of another embodiment of a U-shaped bracket illustrating the principles of the present invention showing how the stake fits inside the bracket;

FIG. 11 is a perspective view of the device of FIG. 1 and of concrete forms showing the device before mounting on top of the forms;

FIG. 12 is a side elevational view of the device of FIG. 1 and of the concrete forms (in cross-section) showing the device mounted on top of the forms;

DESCRIPTION OF THE PREFERRED EMBODIMENTS

The following specification taken in conjunction with the drawings sets forth the preferred embodiments of the present invention in such a manner that any person skilled in the art can use the invention. The embodiments of the invention disclosed herein are the best modes contemplated by the inventor for carrying out his invention in a commercial environment although it should be understood that various modifications can be accomplished within the parameters of the present invention.

Figure 1:
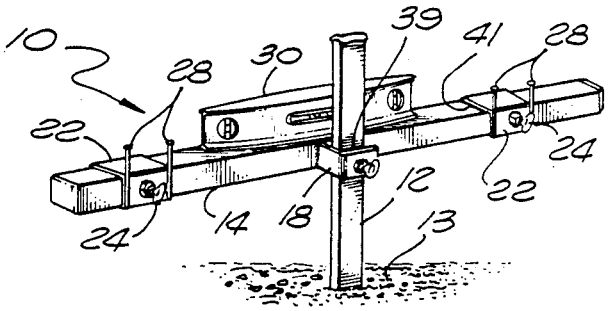
FIG. 1 is a perspective view of an adjustable foundation locating device illustrating the principles of the present invention showing how a stake supporting a horizontal member may be driven into the ground and a level may be placed on top of the member in order to align the member horizontally.
Figure 2:
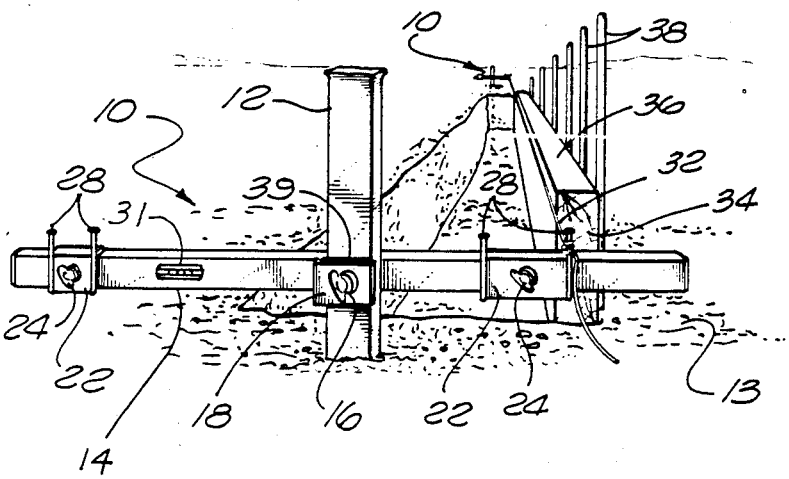
FIG. 2 is a perspective view of the device of FIG. 1 showing how a string tied to nails extending upward from slidable sleeve members of two devices may be used to position a concrete form.

FIGS. 1 and 2 show a preferred embodiment of the adjustable foundation locating device 10 of the present invention. The device 10 uses a stake 12 which is driven into a supporting surface 13 such as the ground for the purpose of supporting a horizontal member 14. Member 14 is free to slide up and down stake 12 and is removably held in place by a bolt 16 which screws into bracket 18, as explained in the following description.

Referring now to FIGS. 4 through 7, bracket 18 is shown welded to horizontal member 14. However, bracket 18 may be attached to horizontal member 14 using any desirable method or may be formed integrally as part of member 14. Preferably, a nut 20 is welded to bracket 18 so that threads 15 of bolt 16 may be screwed into nut 20 until the end of the bolt comes into contact with stake 12 holding horizontal member 14 in position with respect to stake 12, preventing the member from moving up or down the stake. Nut 20 may be attached to bracket 18 using any desirable method or may be formed integrally as part of the bracket if desired. Alternatively, bracket 18 may have internal threads eliminating the need for a nut being attached to the bracket. As such, the height of horizontal member 14 may be adjusted with respect to the ground by loosing bolt 16, moving member 14 up or down the stake 12 until it reaches the desired position, and then tightening bolt 16 to hold member 14 in position. It is important to note that any type of desirable clamping means may be used in place of bolt 16, bracket 18 and nut 20 which will allow the horizontal member 14 to be moved up or down stake 12 and then clamped securely in place. For example, a spring mechanism or other mechanical mechanisms may be used to releasably hold member 14 to the stake 12.

Figure 4:
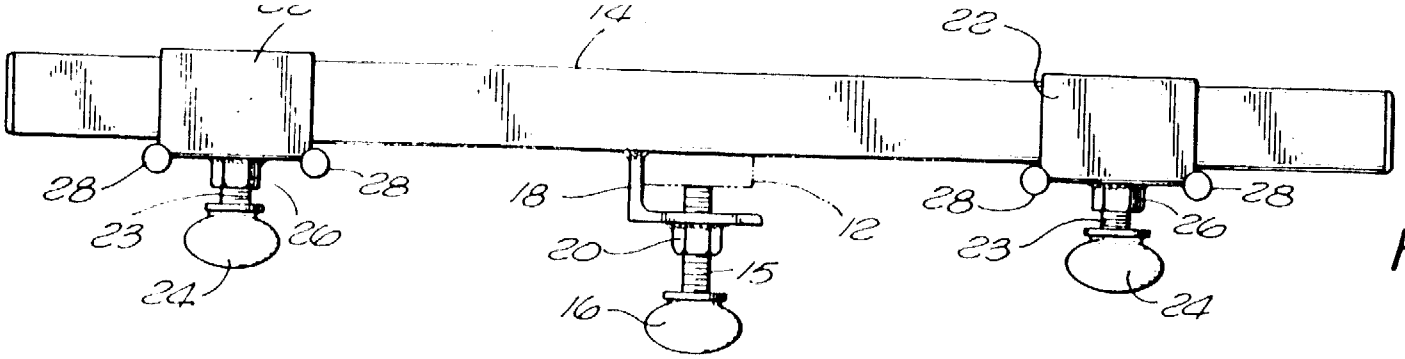
FIG. 4 is a top plan view of the device of FIG. 1 showing how a bolt threaded into a bracket attached to the horizontal member is used to hold the horizontal member to the stake.
Figure 5:
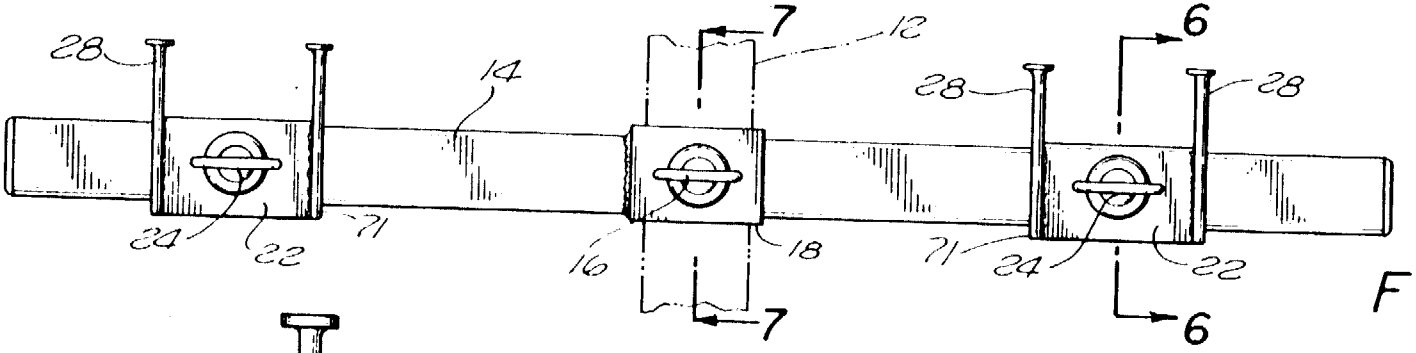
FIG. 5 is a front elevational view of the device of FIG. 1.
Figure 6:
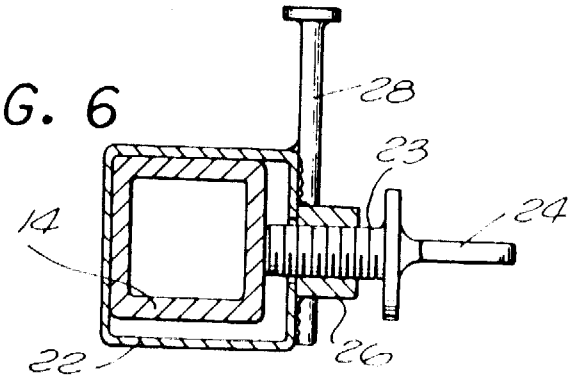
FIG. 6 is a partial cross-sectional view taken in the direction of arrows 6—6 of FIG. 5.

Slidable sleeve members 22 slidably engage and fit around horizontal member 14 (see FIG. 6) so that the sleeve members may be slid longitudinally along member 14 and positioned with respect to stake 12 as desired. Sleeve members 22 are preferably hollow, open at both ends, made out of thin gauge material, and capable of being slid onto and off of both ends of horizontal member 14. Nuts 26, best shown in FIGS. 4 and 6, are preferably welded to the sleeve members 22, but may be attached to the sleeve members using any desirable method or may be formed integrally as part of the sleeve members if desired. Threads 23 of bolts 24 may be screwed into the nuts 26 until the ends of the bolts contact horizontal member 14 preventing the sleeve members from sliding with respect to member 14. Upwardly extending nails 28 are attached to the sleeve members 22 as shown. The nails 28 are preferably welded to members 22, but may be formed integrally as part of members 22. Any type of upwardly extending members may be used in place of nails 28, if desired, so long as strings may be secured to such members as explained in the following discussion. For example, upwardly extending plates or members with holes therein may be used. Also, notches, grooves or holes in the sleeve members 22, or hooks, or the like may be used to secure strings to the sleeve members. Preferably, bolts 16 and 24 with associated wing-type heads for tightening the bolts are used as threaded fasteners.

Figure 7:
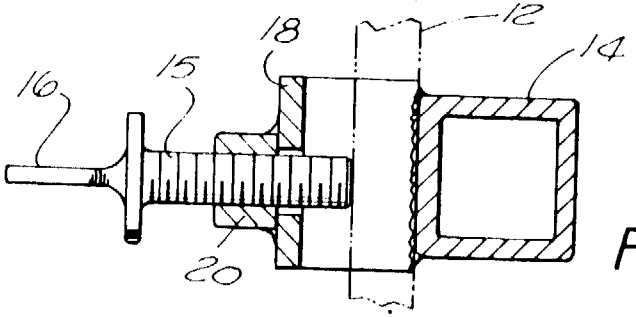
FIG. 7 is a partial cross-sectional view taken in the direction of arrows 7—7 of FIG. 5.

It is important to note that any type of desirable clamping means may be used in place of bolts 24 and nuts 26 which will allow sleeve members 22 to be slid longitudinally along horizontal member 14 and then clamped securely in place for the purpose of positioning nails 28 with respect to stake 12. For example, a spring mechanism or other mechanical mechanisms may be used to releasably hold the sleeve members 22 to horizontal member 14. Also, horizontal member 14 and sleeve members 22 preferably have hollow rectangular-shaped configurations as shown in FIGS. 6 and 7. However, any desirable configurations may be used for members 14 and 22. For example, member 14 may be a length of pipe and members 22 may be smaller lengths of pipe which fit around member 14 like sleeves.

Figure 3:
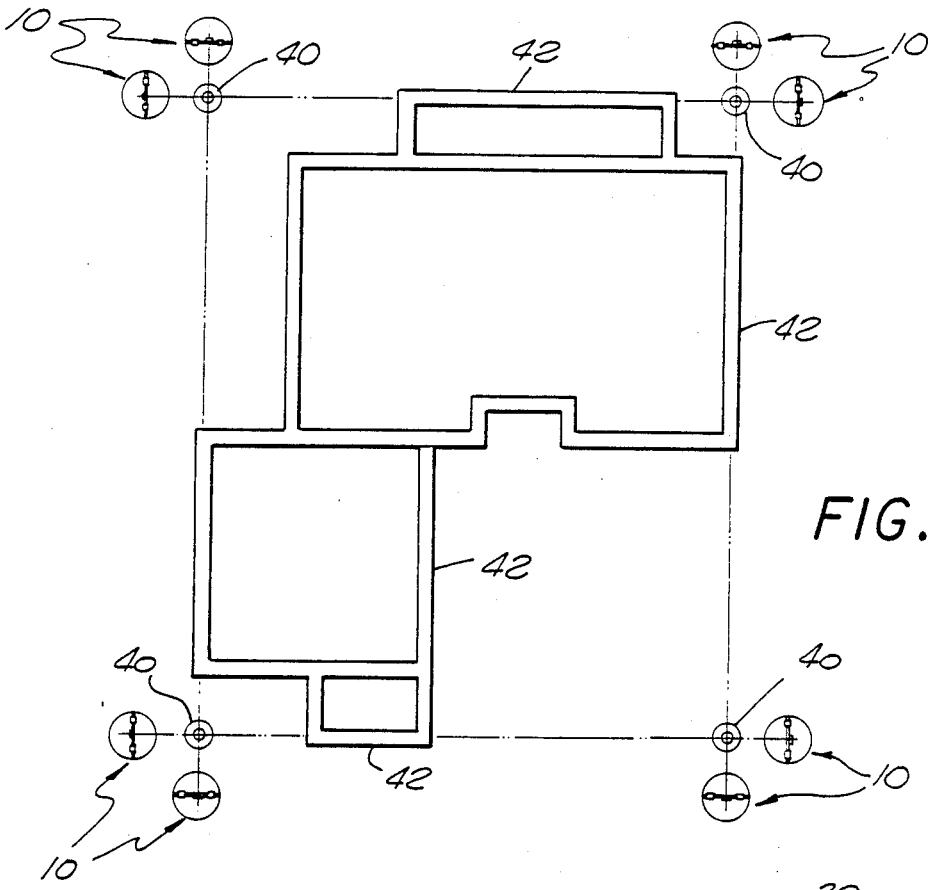
FIG. 3 is a schematic view showing how a number of the devices of FIG. 1 may be located near the corners of a building in order to position the concrete forms or trenches needed for pouring the concrete foundation of the building.

The adjustable foundation locating device 10 may be used as follows. A number of devices 10 may be located near the corners 40 of a building as shown in FIG. 3 to position or locate the concrete forms or trenches needed to pour concrete foundation 42 of the building. Note that the devices 10 will have to be located at other spots around the building in order to locate the concrete forms or trenches needed for the portions of the foundation 42 not located on the rectangle formed by lines connecting corners 40. FIG. 3 shows only some of the possible locations for devices 10 which may be moved to any desirable locations around the building.

Stakes 12 of the device 10 may be located, for example, in alignment with the lines connecting the corners 40 of the building which represnt imaginary centerlines of the foundation 42. However, the stakes 12 may be located on either side of such centerlines, if desired, and typically are driven into the ground at locations which do not have rocks or other debris in the soil making it difficult to drive the stakes into the ground or to keep the stakes stable in an upright position.

After one of the stakes 12 is driven into the ground, horizontal member 14 is moved to a desirable height up the stake 12 corresponding to the height of the concrete form needed to be positioned. A mark 39 (see FIGS. 1 and 2) may be placed on the stake 12 for the purpose of locating horizontal member 14. Bolt 16 is then tightened to securely hold member 14 in place. A level 30 is then placed on top of horizontal member 14 allowing the stake 12 to be adjusted so that member 14 will be in a horizontal position. Alternatively, a smaller version 31 of level 30 may be built into horozontal member 14 is desired as shown in FIG. 2.

Referring now to FIG. 2, after two of the devices 10 are located, for example, at opposite corners of a building or at opposite ends of a trench dug for a concrete foundation, the sleeve members 22 on the same side of the stakes 12 of the two devices 10 are slid along the horizontal members 14 of the devices until nails 28 are located so that a string 32 may be tied to the nails as shown and pulled taut between the two devices locating the desired position of concrete form 34. Marks 41 (see FIG. 1) may be placed on horizontal member 14 for the purpose of locating sleeve members 22 along horizontal member 14. After sleeve members 22 are properly located, bolts 24 are tightened to keep the members in their proper locations. Note that horizontal members 14 are located at heights on stakes 12 so that the string 32 is at a height corresponding to top 36 of concrete form 34. Stakes 8 are typically used to support and position the concrete form 34 using the string 32 as a guide.

FIG. 2 shows only one concrete form 34 being positioned for forming only one side of the concrete foundation 42. However, the sleeve members 22 on the other side of stakes 12 of the devices 10 may be used to position another concrete form (not shown) for the other side of the concrete foundation if desired. Two concrete forms may be used, for example, when the concrete foundation extends above floor level and both sides of the foundation should appear smooth or flat. However, in most cases, the foundation will not be visible and only one concrete form will be needed to pour the foundation.

As discussed above, the foundation locating devices 10 may be used to locate the trenches needed for the foundation 42 prior to positioning the concrete forms. In such a case, horizontal members 14 are positioned at convenient heights on stakes 12 located at opposite ends of the trenches. The sleeve members 22 are then positioned along the horizontal members 14 and strings are tied to the sleeve members and pulled taut between devices 10 providing an outline for the sides of the trenches which may be used to align digging equipment.

The stake 12, horizontal member 14, bracket 18, and sleeve members 22 are preferably made out of metal such as aluminum, stainless steel, or the like to prolong the life of these parts ensuring that the devices 10 may be reused numerous times. However, any suitable material may be used such as plastic, wood, or the like. Also, the parts of the device 10 may be made out of different materials. For example, wooden stakes 12 may be used with a metal horizontal member 14.

FIG. 8 shows a stabilizing member 44 slidably engaged to horizontal member 14. Similar to the sleeve members 22, the stabilizing member 44 slidably engages and fits around horizontal member 14 (see FIG. 9) so that the member 44 can be slid longitudinally along member 14. Stabilizing member 44 is preferably a hollow, sleeve-like member, open at both ends, made out of thin gauge material, and capable of being slid onto and off of both ends of horizontal member 14. A nut 46 is preferably welded to member 44, but may be attached to it using any desirable method or may be formed integrally as part of member 44 is desired. Threads 48 of bolt 50 may be screwed into nut 46 until the end of the bolt 50 contacts horizontal member 14 preventing the stabilizing member 44 from sliding with respect to member 14. Stabilizing member 44 has a block member 52 attached to it.

The stabilizing member 44 may be slid as indicated by arrow 54 in FIG. 8 toward the stake 12 and bracket 18 before bolts 16 and 50 are tightened until it fits between the stake 12 and horizontal member 14 as shown in FIG. 9 with block member 52 in contact with the stake 12. Bolts 16 and 50 may then be tightened securing horizontal member 14 to the stake 12 and the stabilizing member 44 to the horizontal member 14. When so positioned, block member 52 of stabilizing member 44 helps to hold or secure the horizontal member 14 to the stake 12 by contacting the side of the stake 12 helping to stabilize member 14 or prevent it from coming loose from the stake 12.

FIG. 10 shows another embodiment of a U-shaped bracket 56 showing how the stake 12 fits inside the bracket 56. As such, the U-shaped bracket 56 stabilizes the horizontal member 14 or prevents member 14 from becoming loose of the stake 12 so long as bolt 16 is tightened because stake 12 is trapped inside bracket 56 with sides 58 of the bracket 56 in contact with the sides of the stake 12.

The device 10 may be secured to the top of concrete forms 60 as shown in FIGS. 11 and 12 with bracket 18 under flange 62 of one of the forms 60 and bolt 16 tightened to secure the device 10 to the forms 60. The stabilizing member 44 may be used in conjunction with bracket 18 and sleeve member 22 as shown in FIG. 12 to help support and secure the device 10 to the top of the forms 60. Bolt 50 of member 44 may be tightened so that block member 52 is held against side 64 of the forms 60 helping to hold member 14 in place on top of the forms. In addition, block member 52 may be aligned with end 66 (see FIG. 9) of stabilizing member 44 so that side 68 (see FIG. 9) is aligned with side 66 (not shown) to allow member 52 to be positioned on horizontal member 14 in such a way that side 68 of member 52 is in contact with side 64 of the concrete forms 60 helping to hold horizontal member 14 to the top of the forms 60. In such a case, stabilizing member 44 would be positioned between the forms 60.

Similarly, end 71 (see FIG. 5) of sliding member 22 can be used like block member 52 to help secure the horizontal member 14 to the top of the concrete forms. In such a case, sliding member 22 would be located between forms 60 and end 71 would be in contact with side 64 of the forms 60 and bolt 24 would be tightened to help secure member 14 to the forms 60. Once member 14 is positioned on top of the forms 60, string 32 can be tied to nails 28 for establishing alignments needed for pouring concrete.

FIG. 10 shows members 22 and 44 on top of forms 60. However, horizontal member 14 will rest directly on top of the forms 60 when either the stabilizing member 44 or the sleeve member 22 is positioned between the forms 60 for the purpose of helping to secure the member 14 to the top of the forms 60.

Figure 13:
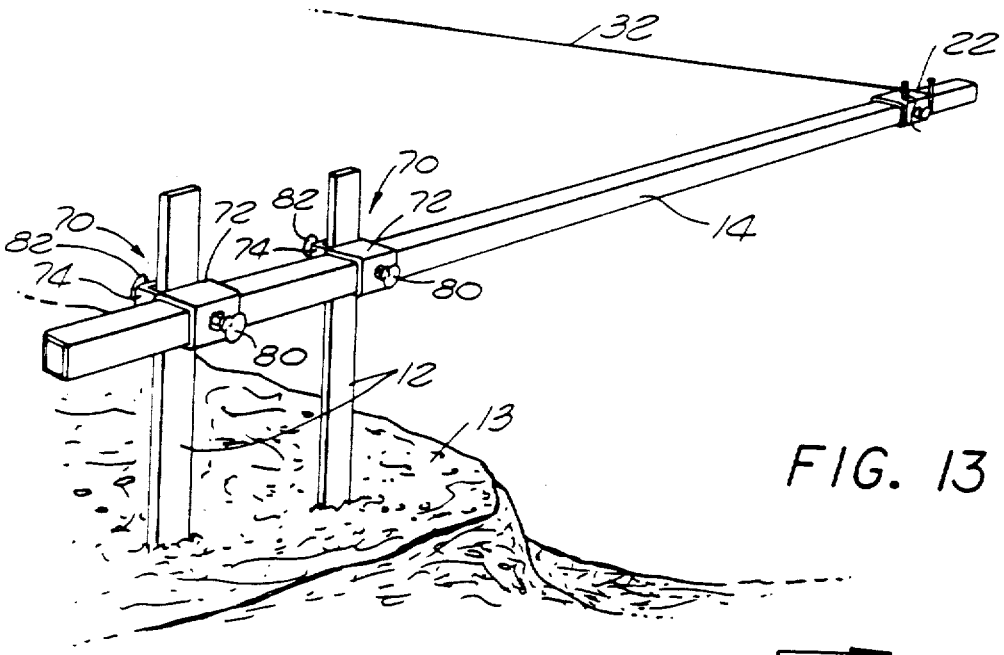
FIG. 13 is a perspective view of another embodiment of the adjustable foundation locating device illustrating the principles of the present invention showing how two adjustable support members mounted on stakes may be used to support and position a horizontal member over a trench with a sleeve member attached near the end of the horizontal member.
Figure 14:
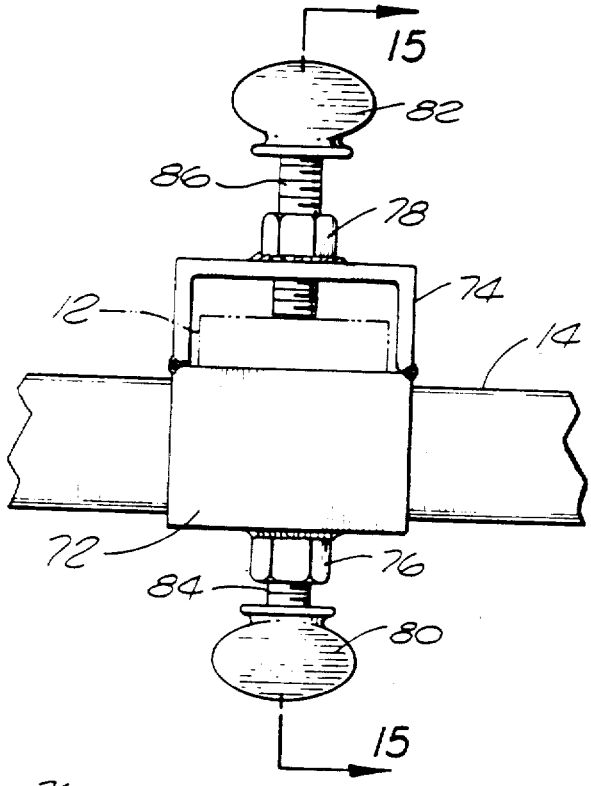
FIG. 14 is an enlarged detailed top plan view in partial cross-section of one of the adjustable support members of FIG. 13 supporting the horizontal member showing how the support member is mounted on a stake.
Figure 15:
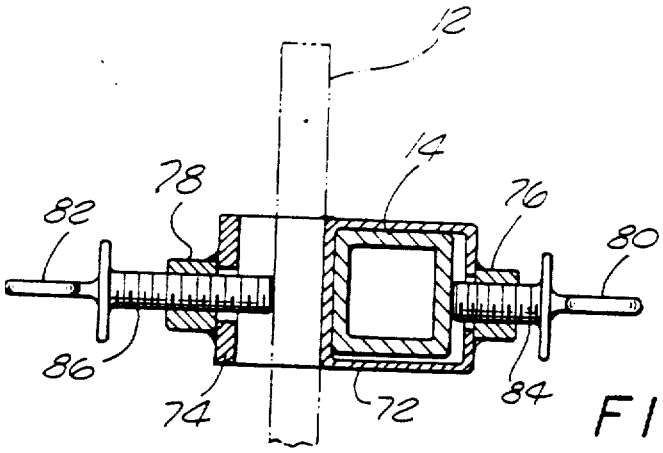
FIG. 15 is a partial cross-sectional view taken in the direction of arrows 14—14 of FIG. 14.

Another preferred embodiment of the adjustable foundation locating device 10 of the present invention is shown in FIG. 13. Two adjustable support members 70 are shown supported by stakes 12 with horizontal member 14 engaged to members 70 and cantilevered over a trench. As shown in FIGS. 14 and 15, horizontal member 14 slidably engages a hollow, open-ended sleeve member 72 of each adjustable support member 70 preferably made of thin gauge material. Each sleeve member 72 has a U-shaped bracket 74 and nut 76 attached to it. A nut 78 is attached to the bracket 74. Bolts 80 and 82 with threads 84 and 86, respectively, are screwed into nuts 76 and 78, respectively.

Bolt 82 of each adjustable support member 70 is capable of being tightened so that its end comes into contact with stake 12 and holds the support member 70 to the stake 12 at any desirable height. Similarly, bolt 80 may be tightened so that its end contacts the horizontal member 14 and secures the member 14 to the support member 70 preventing member 14 from sliding within sleeve member 72. As such, bolt 82 may be loosened and tightened to position the support member 70 at any height up or down stake 12. Likewise, bolt 80 may also be loosened allowing horizontal member 14 to slide to any desirable position with respect to take 12 such as extending over a trench as shown in FIG. 13, and then tightened in order to secure the horizontal member 14 in place in order to position sleeve member 22.

It is important to note that only one adjustable support member 70 may be used with device 10 to support horizontal member 14, or any desirable number of support members 70 may be used with the horizontal member 14 to add additional support for other purposes, each support member 70 being attached to its stake 12. In addition, the support members 70 may be located on opposite sides of the horizontal member 14 if desired. Finally, one or more of the adjustable support members 70 mounted on their stakes 12 may be used in conjunction with a horizontal member 14 having a bracket 18 used to secure the member 14 to a stake. In such a case, the adjustable support members 70 would add additional support to the horizontal member 14.

The above description discloses the preferred embodiments of the present invention. However, persons of ordinary skill in the art are capable of numerous modifications once taught these principles. Thus, by way of example and not of limitation, the sleeve members 22 could be provided with upwardly directed plates having one or more holes therethrough to which guide strings could be secured, and the slide members 22 could be held in place by springs or other mechanical arrangements instead of those shown. In addition to being used for locating concrete forms, trenches and foundations, the adjustable foundation locating device of the present invention may be used to locate pipelines, establish grades, and for many other purposes. Accordingly, it will be understood by those skilled in the art that changes in form and details may be made to the above-described embodiments without departing from the spirit and scope of the invention.

I claim:

1. An adjustable foundation locating device used with a stake for locating foundation trenches and concrete forms comprising:

a contiuous horizontal member releasably coupled to said stake and positioned vertically on said stake at a selected height from a supporting surface, said horizontal member having free ends thereof disposed at opposite sides of said stake;

first meand for releasably and solely engaging said horizontal member to said stake at said selected height and for releasably and solely holding said horizontal member stationary with respect to said stake in a substantially horizontal position;

sleeve member means slidably engaging and fitting around said horizontal member, said sleeve member means selectively position longitudinally along said horizontal member for locating and supporting strings used to locate foundation trenches and position concrete forms; and second means for releasably holding said sleeve member means to said horizontal member at selected positions longitudinally along said horizontal member.

2. The device of claim 1 wherein said sleeve member means includes a sleeve member slidably engaging said horizontal member and nails extending upward from said sleeve member.

3. The device of claim 2 wherein said second means includes a bolt threaded into said sleeve member.

4. The device of claim 3 wherein said first means includes a bracket attached to said horizontal member and a bolt threaded into said bracket.

5. The device of claim 1 wherein said sleeve member means includes two sleeve members slidably engaging said horizontal member, said sleeve members located at said opposite sides of said stake.

6. The device of claim 1 further comprising a level built into said horizontal member.

7. The device of claim 1 wherein said horizontal member is a hollow metal tube of rectangular cross-section.

8. The device of claim 1 wherein said first means includes a threaded fastener with associated wing-type head for manually tightening said threaded fastener.

9. The device of claim 1 wherein said second means includes a threaded fastener with an associated wing-type head for manually tightening said threaded fastener.

10. The device of claim 1 further comprising third means connected to said first means for releasably positioning said horizontal member longitudinally along a longitudinal axis thereof perpendicular to said stake.

11. The device of claim 10 wherein said first means comprises a bracket and a bolt threaded into said bracket, and said third means comprises a hollow, open-ended sleeve member attached to said bracket and a bolt threaded into said sleeve member, said horizontal member slidably engaging said sleeve member through open ends of said hollow open-ended sleeve member.

12. The device of claim 1 further comprising stabilizing means, slidably engaging said horizontal member, for co-acting with said first means in order to help releasably secure and stabilize said horizontal member to said stake.

13. An adjustable foundation locating device used with a stake for locating foundation trenches and concrete forms comprising:

a continuous horizontal member releasably engaged to said stake and capable of being positioned vertically on said stake at a selected height from a supporting surface, said horizontal member having free ends thereof disposed at opposite sides of said stake;

a bracket attached to said horizontal member;

a first bolt threaded into said bracket, said first bolt when tightened releasably and solely holds said horizontal member at said selected height and stationary with respect to said stake and in a substantially horizontal position;

at least one sleeve member slidably engaging and fitting around said horizontal member, each of said sleeve members moved longitudinally along said horizontal member in order to locate strings used to position foundation trenches and concrete forms, each of said sleeve members having at least one upwardly extending nail attached thereto, each one of said strings being tied to one of said nails; and each of said sleeve members having a second bolt threaded thereinto, said second bolts releasably secure said sleeve members to said horizontal member when tightened.

14. The device of claim 13 wherein said device has two of said sleeve members, each of said two sleeve members located at said opposite sides of said stake.

15. The device of claim 13 further comprising a level built into said horizontal member.

16. An adjustable foundation locating device used with a stake for locating foundation trenches and concrete forms comprising:

a horizontal member releasably coupled to said stake and capable of being positioned vertically on said stake at a selected height from a supporting surface;

first means for releasably engaging said horizontal member to said stake at said selected height;

sleeve member means slidably engaging and fitting around said horizontal member, said sleeve member means capable of being selectively positioned longitudinally along said horizontal member for locating and supporting strings used to locate foundation trenches and position concrete forms;

second means for releasably holding said sleeve member means to said horizontal member at selected positions longitudinally along said horizontal member; and stabilizing means, slidable engaging said horizontal member, for co-acting with said first means in order to help releasably secure and stabilize said horizontal member to said stake, said stabilizing means comprising a hollow, open-ended sleeve member, a bolt threaded into said sleeve member and a block member attached to said sleeve member.

17. A method of positioning foundation trenches and concrete forms comprising the steps of:

driving two stakes into a supporting surface, each of said stakes being located near one of the ends of a foundation;

selectively positioning a continuous horizontal member on each of said stakes at a selected height from said supporting surface so that each horizontal member has free ends thereof positioned at opposite sides of a corresponding one of said stakes;

releasably securing said horizontal members to said stakes using a single means for securing said horizontal members to said stakes so that said horizontal members are held stationary with respect to said stakes;

sliding a sleeve member longitudinally along each of said horizontal members until said sleeve member is at a selected location;

securing said sleeve members to said horizontal members;

leveling each of said horizontal members to a substantially horizontal position;

tying strings to each of said sleeve members so that said strings are pulld taut and are substantially horizontal between said horizontal members; and selectively positioning said foundation trenches and said forms using said strings as guides for each of said trenches and each of said forms.

18. The method of claim 17 wherein said step of sliding sleeve members further includes sliding said sleeve members on each of said horizontal members at opposite sides of said stakes.

19. The method of claim 17 further comprising the step of sliding each of said horizontal members longitudinally along a longitudinal axis thereof with respect to its corresponding stake to a desired longitudinal position after selectively positioning and releasably securing said horizontal members at said selected heights from said support surface and before sliding said sleeve members to said selected locations.

20. The method of claim 19 wherein said horizontal members slidably engage adjustable support members releasably engaged to said stakes.

* * * * *

UNITED STATES PATENT AND TRADEMARK OFFICE

CERTIFICATE OF CORRECTION

PATENT NO. : 4,932,134

DATED June 12, 1990

INVENTOR(S) : Dexter L. Meadows

It is certified that error appears in the above-identified patent and that said Letters Patent is hereby corrected as shown below:

The sheet of drawings consisting of Figs. 4-15 should be added as per attached sheet.

Title page "20 Claims, 1 Drawing Sheet" should read

-- 20 Claims, 4 Drawing Sheets--

Signed and Sealed this

Twenty-fourth Day of September, 1991

*Attest:*

HARRY F. MANBECK, JR.

*Attesting Officer*

*Commissioner of Patents and Trademarks*

FIG. 8
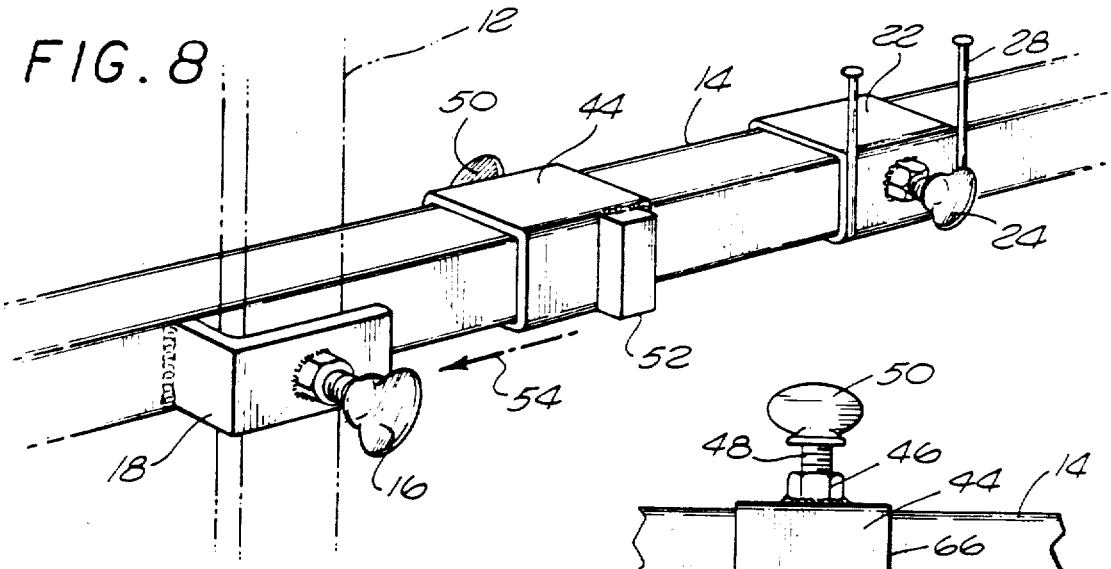
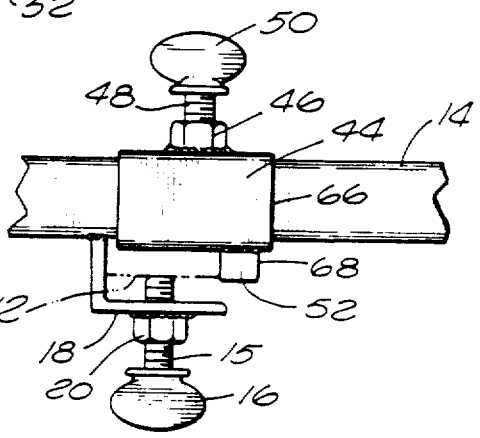
FIG. 9
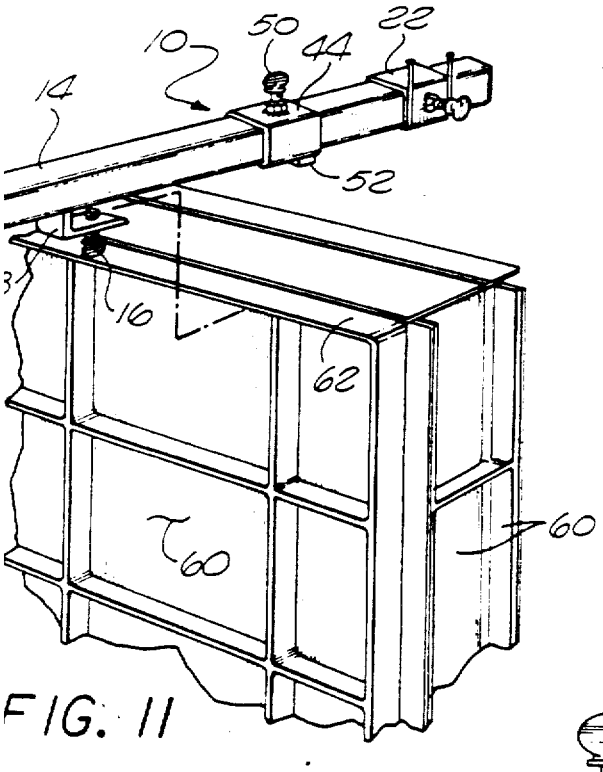
FIG. 11
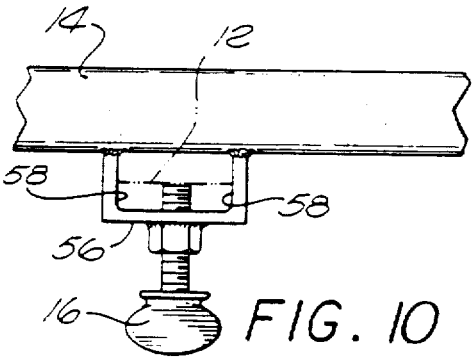
FIG. 10
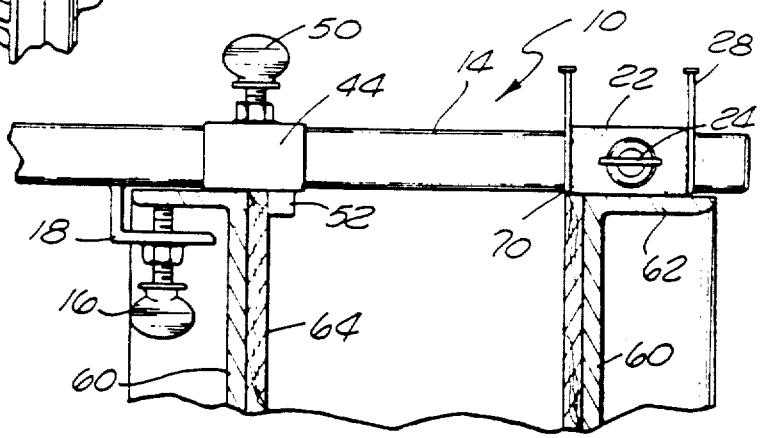
FIG. 12